US007182675B2

(12) United States Patent
Rhoades

(10) Patent No.: US 7,182,675 B2
(45) Date of Patent: Feb. 27, 2007

(54) APPARATUS FOR ABRADING THE REGION OF INTERSECTION BETWEEN A BRANCH OUTLET AND A PASSAGEWAY IN A BODY

(75) Inventor: Lawrence J. Rhoades, Pittsburgh, PA (US)

(73) Assignee: Extrude Hone Corporation, Irwin, PA (US)

( * ) Notice: Subject to any disclaimer, the term of this patent is extended or adjusted under 35 U.S.C. 154(b) by 0 days.

(21) Appl. No.: 11/434,305

(22) Filed: May 15, 2006

(65) Prior Publication Data

US 2006/0205329 A1 Sep. 14, 2006

Related U.S. Application Data

(62) Division of application No. 10/323,532, filed on Dec. 18, 2002, now Pat. No. 7,044,842, which is a division of application No. 09/660,008, filed on Sep. 12, 2000, now Pat. No. 6,503,126.

(51) Int. Cl.
*B24C 3/32* (2006.01)

(52) U.S. Cl. ..... 451/76; 451/99; 451/102

(58) Field of Classification Search ..... 134/8, 134/22, 22.12, 22.18, 23, 24, 54, 152, 166 R, 134/167 R, 169 C; 451/36, 51, 52, 60, 61, 451/76, 91, 99, 102, 446
See application file for complete search history.

(56) References Cited

U.S. PATENT DOCUMENTS

| | | | |
|---|---|---|---|
| 3,299,459 | A | 1/1967 | McCune |
| 4,055,025 | A | 10/1977 | Seese et al. |
| 5,054,247 | A | 10/1991 | Rhoades et al. |
| 5,085,244 | A | 2/1992 | Funk |
| 5,195,276 | A | 3/1993 | Vennerholm |
| 5,198,037 | A | 3/1993 | Guyonnet et al. |
| 5,679,058 | A | 10/1997 | Rhoades |
| 6,047,714 | A | 4/2000 | Akazawa |

OTHER PUBLICATIONS

Sketch of system commercially sold in 1985, labeled as Exhibit A.

*Primary Examiner*—Timothy V. Eley
(74) *Attorney, Agent, or Firm*—Larry R. Meenan

(57) ABSTRACT

A method and apparatus are disclosed for abrading the inner surface at the intersection region of a branch outlet with the wall of a body having a passageway. Using abrasive flow machining, it is possible to abrade the intersection region to provide a smooth transition between the wall and the branch outlet.

1 Claim, 6 Drawing Sheets

APPARATUS FOR ABRADING THE REGION OF INTERSECTION BETWEEN A BRANCH OUTLET AND A PASSAGEWAY IN A BODY

CROSS-REFERENCE TO RELATED APPLICATION

This application is a divisional of U.S. application Ser. No. 10/323,532 filed Dec. 18, 2002, and issued as U.S. Pat. No. 7,044,842 on May 16, 2006, which is a divisional of U.S. application Ser. No. 09/660,008 filed Sep. 12, 2000, now U.S. Pat. No. 6,503,126 issued Jan. 7, 2003.

BACKGROUND OF THE INVENTION

1. Field of the Invention

The invention relates to abrasive flow machining and, more particularly, the use of abrasive flow machining to polish the region of intersection between a branch outlet and a passageway in a body.

2. Background Art

Abrasive flow machining is used for working metals and related materials, particularly for machining and finishing internal shapes, bores, orifices and complex three-dimensional shapes and as an alternative to certain other difficult machining operations. Abrasive flow machining is particularly used for deburring, radiusing, resizing, and polishing/finishing operations.

Abrasive flow machining incorporates the use of a plastic or semi-solid media containing abrasive particles distributed substantially uniformly throughout. The purpose of the semi-solid media is to transport the abrasive particles through a passage of a workpiece to achieve the desired machining results as illustrated in U.S. Pat. No. 5,054,247, which is hereby incorporated by reference.

Abrasive flow machining may incorporate the use not only of a plastic or semi-solid media containing abrasive particles, but may additionally include a liquid or oil-based media also containing abrasive particles distributed substantially uniformly throughout. A liquid media will provide easier cleanup through passageways and medium delivery tubes.

Nevertheless, whether the abrasive media is a semi-solid media, a liquid, or oil-based media, ideally, the media may range in look and feel from a highly viscous material to an extremely low viscosity fluid. The most effective media for a specific application will depend upon the geometric characteristics of the application and the materials to be abraded or polished.

The application-specific media would have such viscosity and rheology that it flows at a suitable rate through an outlet or orifice under an imposed or gravitational force where the rate is defined by the abrasive flow processing requirements.

Considerations for media selection for a particular application may be based upon a number of considerations. Preferably, the media must flow through a delivery tube and through passageways requiring surface, radius, or opening machining by the abrasive flow process. Furthermore, the media must exhibit sufficient rheological behavior during flow through passageways to achieve the desired machining action. Additionally, the media must maintain coherence during flow sufficient to achieve the radiusing action where and when it is required. Finally, the media must provide a machining action and lubrication to such a degree to maintain the required flow rates and perform the appropriate abrasive processing.

Suitable types of media that possess the desired rheological behaviors required for this application include those identified in U.S. Pat. No. 5,679,058, entitled "Abrasive Jet Cutting Medium", assigned to the assignee of the present invention and herein incorporated by reference. Also appropriate for this application is media that contains a suprapartcle structure or a sufficiently flexible and shearable, yet sufficiently cohesive microstructure.

When the workpiece consists of a body having a passageway with multiple openings extending over the length of the passageway, such as, for example, a fuel rail or automobile manifold, the abrasive flow machining in the region of the intersection of the multiple branch outlets with the passageway of the body is accomplished by flowing the abrasive media through the passageway to each branch outlet. For purposes of discussion, a body having a passageway will encompass a manifold, pipe, tube, or conduit with at least one inlet and two or more outlets.

Directing attention to FIG. 1, a sectioned schematic is illustrated of a body 10 having a passageway 11 including multiple branch outlets 15 each defined by an opening 20 extending through a wall 25 of the body 10. A typical branch outlet 15 having an opening 20 will be discussed with the understanding that such a discussion may also be applied to any of the remaining branch outlets and associated openings. The opening 20 of a branch outlet 15 is typically created by a drilling operation which leaves, as illustrated in FIG. 2, a burr 30 around the periphery 35 of the opening 20. The burr 30 protrudes from the opening 20 and creates a discontinuity on the body inner surface 40 at the intersection region 37 defined by the intersection of the periphery 35 of the opening 20 with the body wall 25.

FIG. 1 illustrates a prior art technique for removal of burrs 30 and subsequent polishing of the underlying surface by abrasive flow machining. In particular, a flowable abrasive media 45 is introduced into a passageway 11 from one end 55 of the passageway 11. The media 45 is moved under pressure toward opposite end 60 of the passageway 11. The burr 30 is removed and the underlying surface polished by the flow of the abrasive media 45 over the surface of the burr 30. For a body 10 having multiple branch outlets, as illustrated in FIG. 1, it is necessary to direct the flow of the media 45 through at least one branch outlet 15 at a time.

It should be appreciated the abrasive flow technique is most effective with ample media flow through any one branch outlet 15 and, therefore, while it may be possible to pass the media 45 through a number of different branch outlets, it is oftentimes preferred to direct the media 45 through a single branch outlet 15 to maximize the effectiveness of the abrasion technique.

To accomplish this, the body 10 is mounted within an assembly having a plurality of plugs which may be selectively activated to seal one or more branch outlets 15 thereby preventing flow of the media 45 through that branch outlet 15. For purposes of discussion, a single plug 65 will be addressed with the understanding that this plug is representative of the remaining plugs. As illustrated in FIG. 1, when the plug 65 is moved away from the branch outlet 15, the media 45 flows past the opening 20 and is ejected at the branch outlet 15.

Using this technique, the burr 30, illustrated in FIG. 2, is largely removed from the periphery 35 of the opening 20 as illustrated in FIG. 3.

While this technique is effective in removing a large portion of the burr 30, as illustrated in FIG. 3, there is still a portion of the burr 30 remaining. This is created by the unidirectional flow of the media 45 in the passageway 11 and results not only in a small burr 30 remaining but, furthermore, results in a non-uniform radiusing of the periphery 35 of the opening 20. In particular, the abrasion of an upstream surface 70 on the periphery 35 of the opening exceeds that of a downstream surface 75, as illustrated in FIG. 3.

Additionally, the assembly used for manipulating the plurality of plugs, which act to block media 45 flow through the branch outlets, is a fairly complex assembly and must be customized for each body. Such an arrangement is very costly and setup using such an arrangement is time-consuming. Furthermore, physical interference caused by the assembly makes it difficult to capture and contain the media 45 as it leaves the branch outlet 15. Finally, using the arrangement illustrated in FIG. 1, the entire passageway 11 is filled with abrasive media 45 and then the media 45 is selectively released through the desired outlet 15 to initiate the abrasion process. This creates a surplus of media 45 within the passageway 11 that must be removed when the abrasion process is complete.

A method is needed for directing the flowable abrasive media 45 through the passageway 11 in an efficient manner without the need of the complex assembly utilizing movable plugs, without requiring the associated extensive setup time, and without the need to completely fill the passageway with media prior to the abrasion process.

Furthermore, a method is desired to eliminate the non-uniform abrasion about the periphery 35 of the opening 20 caused by the unidirectional flow of the flowable abrasive media 45.

SUMMARY OF THE INVENTION

In a first embodiment of the invention, for a body having a wall with an inner surface along a passageway and at least one branch outlet defined by an opening extending through the wall, a method for abrading the inner surface at an intersection region defined by the intersection of the periphery of the opening at the wall comprises the steps:

a) positioning a first media delivery tube within a first end of the passageway, wherein the first tube has an inlet and an outlet and wherein the outlet is proximate to the periphery of the opening;

b) supplying a flowable abrasive media through the inlet of the first tube to the outlet; and c) guiding the media from the outlet of the first tube through the opening.

Guiding the media may involve positioning a deflector within the passageway to direct the flow of media through the opening.

In a second embodiment of the invention, a second media delivery tube may be positioned within the passageway opposite the first media delivery tube and media provided through it such that the opposing flow of media from the first and second tubes is directed through the opening.

In a third embodiment of the invention, the first and second media delivery tubes are combined into a single tube having a tube outlet between two inlets. The tube outlet is aligned with the opening in the passageway and media is directed through the opening.

In a fourth embodiment, baffles are attached to the first delivery tube around the tube outlet, thereby defining a flow path from the tube outlet directly through the opening.

Both methods and assemblies are associated with each of these embodiments.

DETAILED DESCRIPTION OF THE PREFERRED EMBODIMENTS

Unlike methods used in the past, the method according to each embodiment of the subject invention in each instance introduces flowable abrasive media 45 within the passageway 11 through the use of at least one media delivery tube 100.

As previously mentioned, the abrasive media 45 may be a semi-solid media, a liquid, or an oil-based media.

Figure 1:
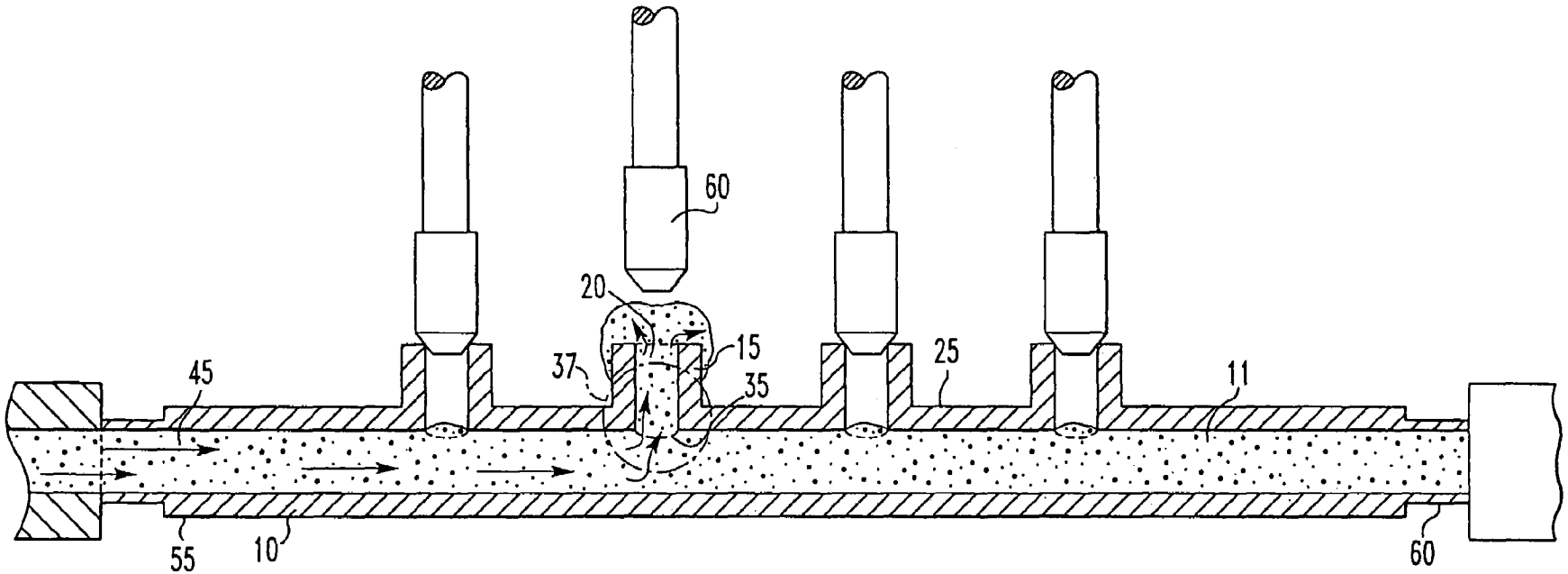
FIG. 1 PRIOR ART
FIG. 1 is a sectioned schematic illustration of a body having a passageway with multiple branch outlets, wherein one branch outlet is being processed by a flowable abrasive media using a prior art technique.
Figure 4:
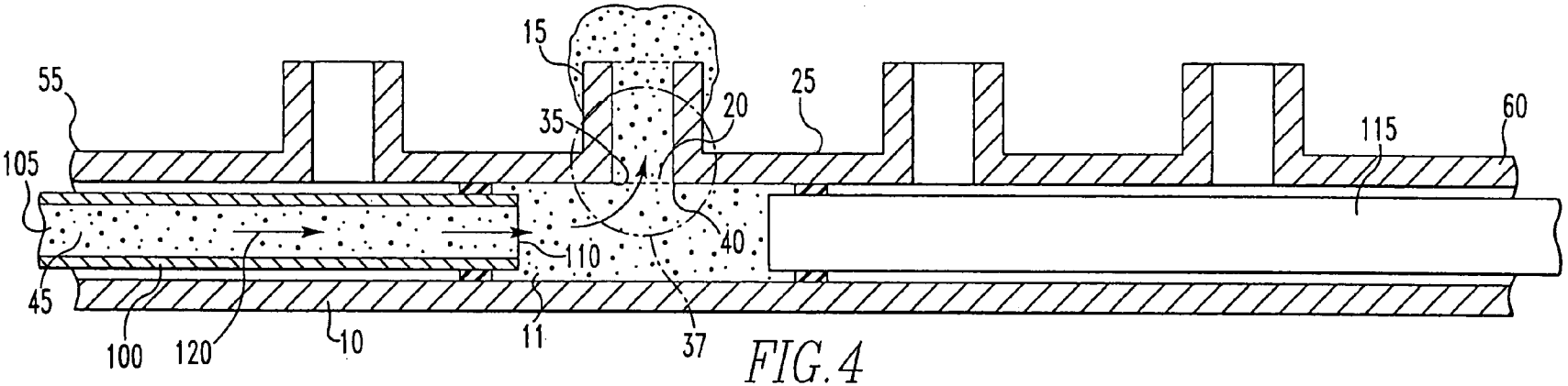
FIG. 4 is a sectional schematic illustration of one embodiment of the subject invention utilizing a media delivery tube and a deflector.

FIG. 4 illustrates a body 10 similar to that in FIG. 1, wherein the body 10 has a wall 25 with an inner surface 40 along a passageway 11 and at least one branch outlet 15 defined by an opening 20 extending through the wall 25. In a first embodiment, the subject invention is directed to a method and apparatus of abrading the inner surface 40 at an intersection region 37 defined by the intersection of the periphery 35 of the opening 20 at the wall 25.

The media delivery tube 100 has an inlet 105 and an outlet 110. The media delivery tube 100 is positioned within the passageway 11 such that the outlet 110 is proximate to the periphery 35 of the opening 20 to be processed.

The term "proximate", as applied herein, is intended to define the position of the delivery tube outlet 110 relative to an opening 20. To be proximate, the outlet 110 must release abrasive media 45 within the passageway 11 at a distance from the opening 20 so that the flow of abrasive media 45 will act upon the opening 20. The delivery tube outlet 110 cannot extend into a projection of the opening 20 within the passageway 11.

Flowable abrasive media 45 is supplied through the inlet 105 of the media delivery tube 100 to the outlet 110. The media 45 is supplied under pressure from a reservoir.

Figure 2:
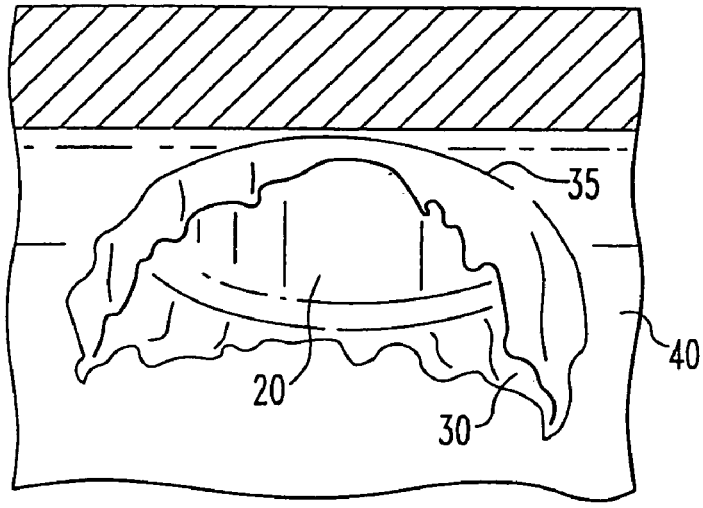
FIG. 2 PRIOR ART
FIG. 2 is an enlarged perspective view of an opening with a burr to be removed using the abrasive machining process.

To prevent the media 45 from traveling through other branch outlets or further down the passageway 11, the media 45 is guided from the outlet 110 of the delivery tube 100 through the opening 20. In the embodiment illustrated in FIG. 4, this is accomplished by positioning a deflector 115 within the passageway 11 proximate to the periphery 35 of the opening 20, but at a position opposed to that of the delivery tube 100, thereby obstructing the flow of the media 45 to direct it through the opening 20 in a first direction identified by arrow 120 from the passageway end 55 toward the branch outlet 15. Abrasive media 45 provided through the delivery tube 100 will then be directed to travel past the opening 20 and through the branch outlet 15, thereby providing to the periphery of the opening the necessary processing to remove a significant portion of a burr 30 (FIGS. 2 and 3).

For purposes of discussion, only a single branch outlet 15 with an opening 20 will be discussed with the understanding that the arrangement of the delivery tube 100 and the deflector 115 may be moved within the passageway 11 to accommodate any of the other openings and associated branch outlets.

Figure 3:
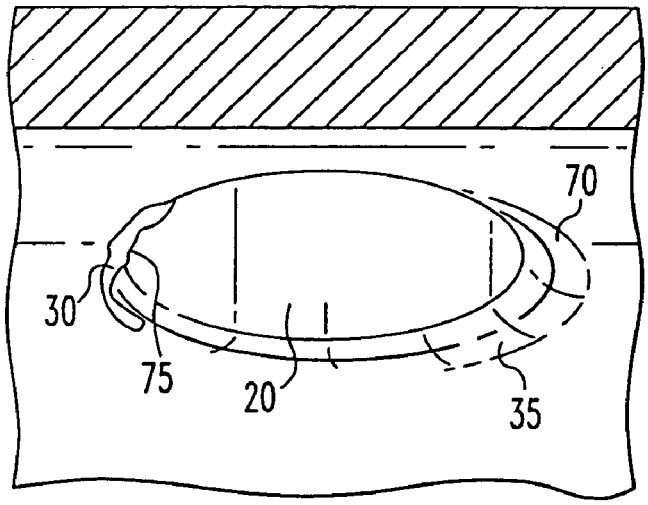
FIG. 3 PRIOR ART
FIG. 3 is a perspective view of an opening of a branch outlet subjected to unidirectional flow of the flowable abrasive media in an abrasive machining process.
Figure 5:
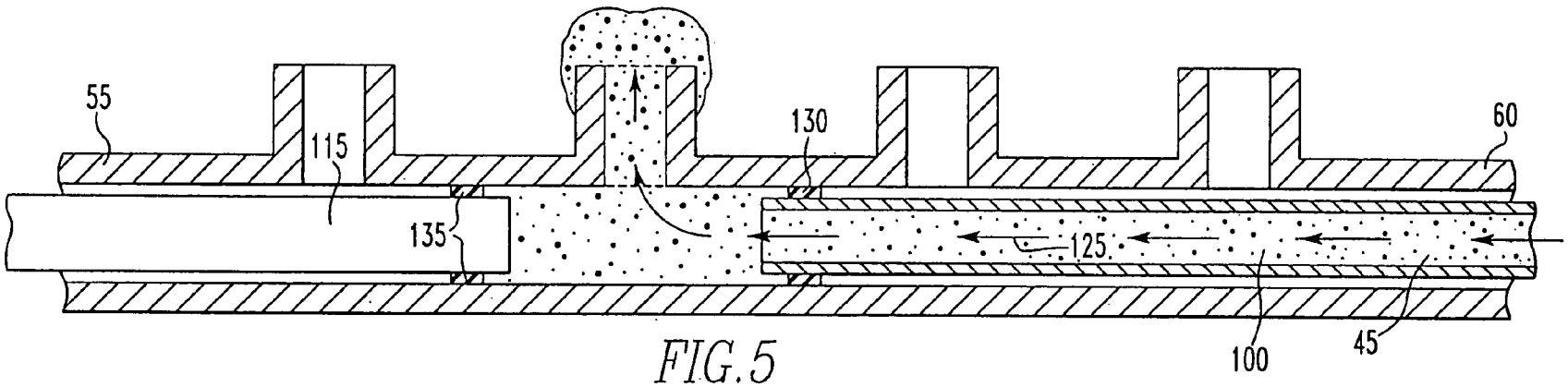
FIG. 5 is a sectional schematic illustration of an arrangement similar to that in FIG. 4, wherein the media delivery tube and deflector are in opposite positions within the passageway of the body.

Because the arrangement illustrated in FIG. 4 provides only unidirectional flow, the same asymmetry illustrated by the periphery 35 of opening 20 in FIG. 3 occurs. As a result, after the step of guiding the media 45 in a first direction 120, as illustrated in FIG. 5, the delivery tube 100 must be repositioned within the second end 60 of the passageway 11 such that the delivery tube outlet 110 is proximate to the periphery 35 of the opening 20. It is further necessary to reposition the deflector 115 within the first end 55 of the passageway 11 proximate to the periphery 35 of the opening 20, thereby obstructing the flow of the media 45 to direct it through the opening 20 from the second direction indicated by arrow 125.

It should be appreciated that positioning the delivery tube 100 and the deflector 115 may involve securing the body 10 in a fixed position and moving the delivery tube 100 and deflector 115 within the passageway 11 to properly position them next to an opening of a branch outlet. It is also possible to maintain the delivery tube 100 and deflector 115 in fixed positions and to move the body 10 to accommodate the openings of different branch outlets on the body 10.

To prevent the media 45 from flowing between the delivery tube 100 and the inner surface 40 of the wall 25, the media delivery tube 100 at the intersection region 37 may have a shape and cross-sectional area close to that of the shape and cross-sectional area of the passageway 11. However, it is also possible, when the cross-sectional areas and/or shapes are significantly different, to introduce seals 130 extending from the delivery tube 100 radially outward to minimize the gap between the delivery tube 100 and the inner surface 40 of the wall 25 in the area of the intersection region 37. The same concept may be applied to the deflector 115 and FIG. 5, for example, illustrates seals 135 about the deflector 115.

Figure 6:
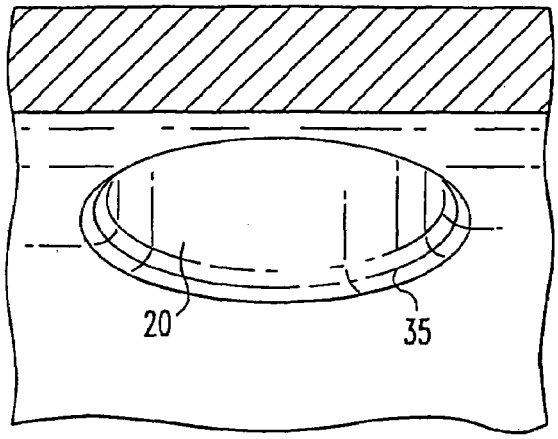
FIG. 6 is a sectional schematic illustration of a perspective of an opening subjected to bidirectional flow of flowable abrasive media in an abrasive machining process.

By repositioning the delivery tube 100 and the deflector 115, the flow of abrasive media 45 may be provided in a second direction in conjunction with abrasive media 45 already supplied from a first direction, thereby providing bidirectional flow and the subsequent uniform abrasion of the periphery 35 of the opening 20, as illustrated in FIG. 6.

Figure 7:
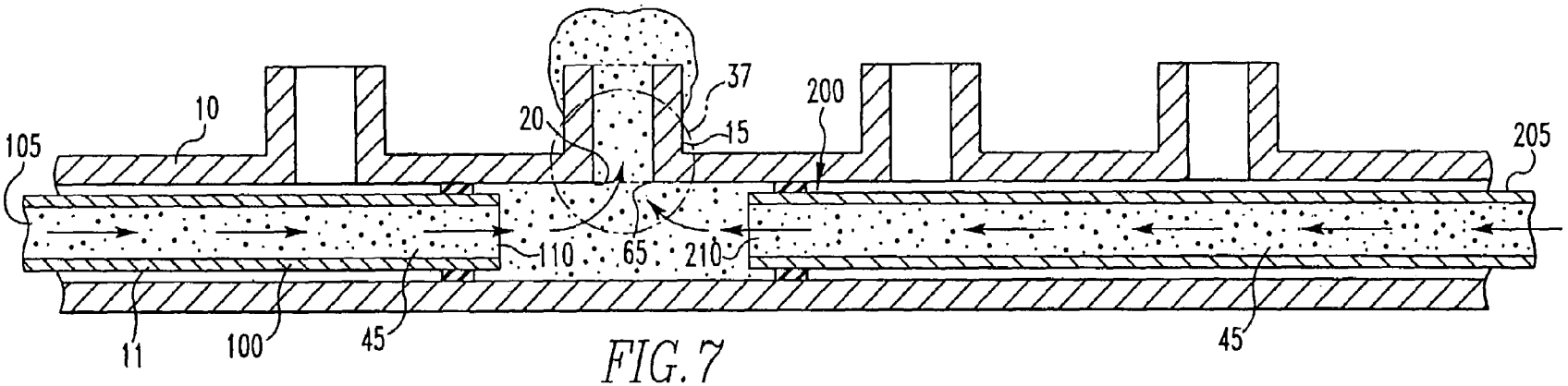
FIG. 7 is a sectional schematic illustration of a second embodiment of the subject invention, whereby two media delivery tubes are introduced from opposite ends of the passageway.

FIG. 7 illustrates an arrangement whereby a first delivery tube 100 having an inlet 105 and an outlet 110 is positioned within the passageway 11 such that the outlet 110 is proximate to the opening 20 of the branch outlet 15. As opposed to introducing a deflector 115, as discussed with respect to FIGS. 4 and 5, a second media delivery tube 200 may be positioned within the passageway 11. The second delivery tube 200 has an inlet 205 and an outlet 210. The outlet 210 is proximate to the periphery 35 of the opening 20 in an opposing relationship with that of the outlet 110 of delivery tube 100. Flowable abrasive media 45 may now be provided through the inlets 105, 205 of both the first delivery tube 100 and the second delivery tube 200 positioned on each side of the opening 20 such that the flow of media 45 is directed through the opening 20 in a bidirectional manner. In this fashion, the periphery 35 of the opening 20 is processed in a symmetric manner, as illustrated in FIG. 6.

Just as previously mentioned with the embodiments described in FIGS. 4 and 5, either the delivery tubes 100, 200 or the body 10 may be fixed, while the other is moved into the desired position.

While FIG. 7 has described an embodiment in which a first delivery tube 100 and a second delivery tube 200 are positioned within a passageway 11, each of these tubes is an independent piece.

Figure 8:
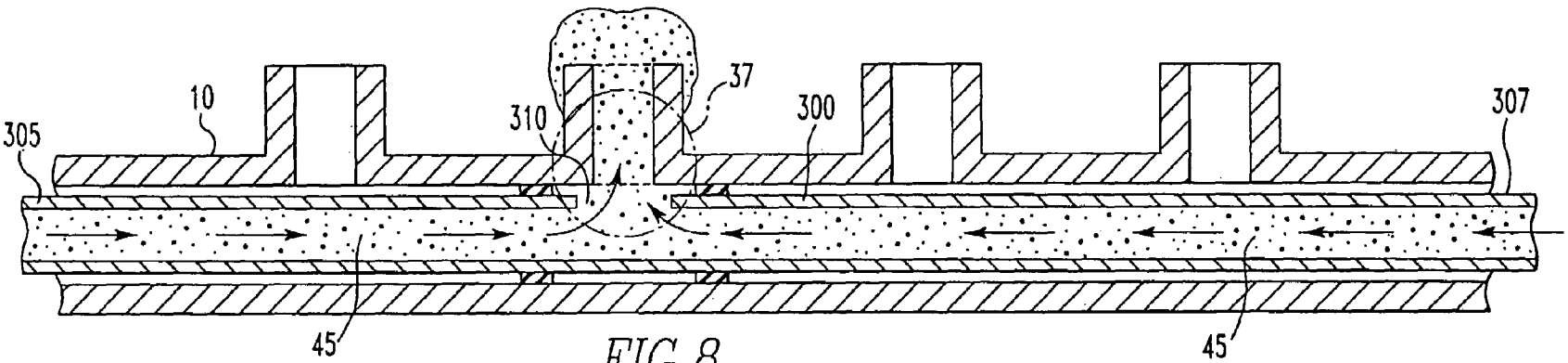
FIG. 8 is a sectional schematic illustration of a third embodiment of the subject invention, whereby a single media delivery tube has an opening positioned adjacent a branch outlet in which abrasive media is to be introduced.

Directing attention to FIG. 8, it is entirely possible for a single delivery tube 300 to have a first inlet 305 and a second inlet 307 with an outlet 310 between them. As a result, the step of supplying flowable abrasive media 45 is comprised of not only supplying media 45 through the first inlet 305 but, furthermore, providing media 45 through the second inlet 307 of the delivery tube 300 to the outlet 310. In such a fashion, the flow of media 45 from each inlet 305, 307 approaches the intersection region 37 from a different direction, thereby providing bidirectional flow with the subsequent uniform abrasion of the periphery 35 of the opening 20 as illustrated in FIG. 6.

Just as before, the body 10 may be fixed and the delivery tube 300 moved within the body 10 or, in the alternative, the delivery tube 300 may be fixed and the body 10 moved over it to index the outlet 310 to provide media 45 to different branch outlets along the length of the passageway 11.

What has been discussed so far is a method for guiding the abrasive media 45 once it leaves the outlet of the delivery tube by physically blocking the entire passageway downstream of the tube outlet. It is also possible to selectively guide the flow of the media 45 to a particular opening 20 of a branch outlet 15.

Figure 13:
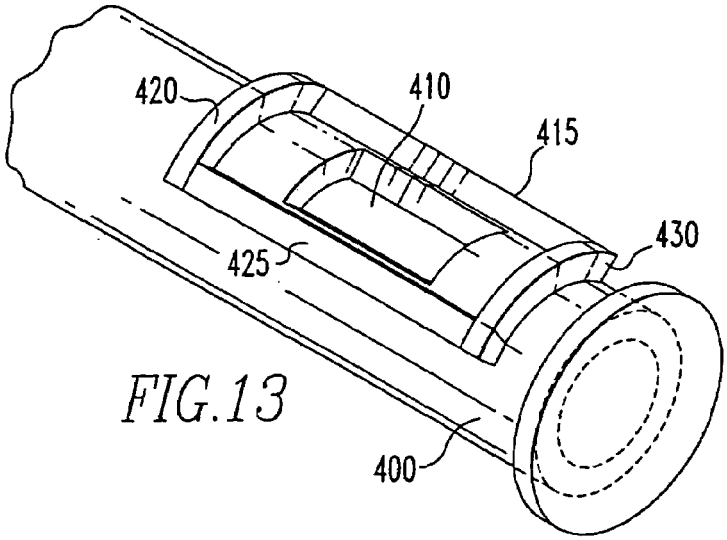
FIG. 13 is a perspective view of the media delivery tube illustrated in FIGS. 9–12.
Figure 9:
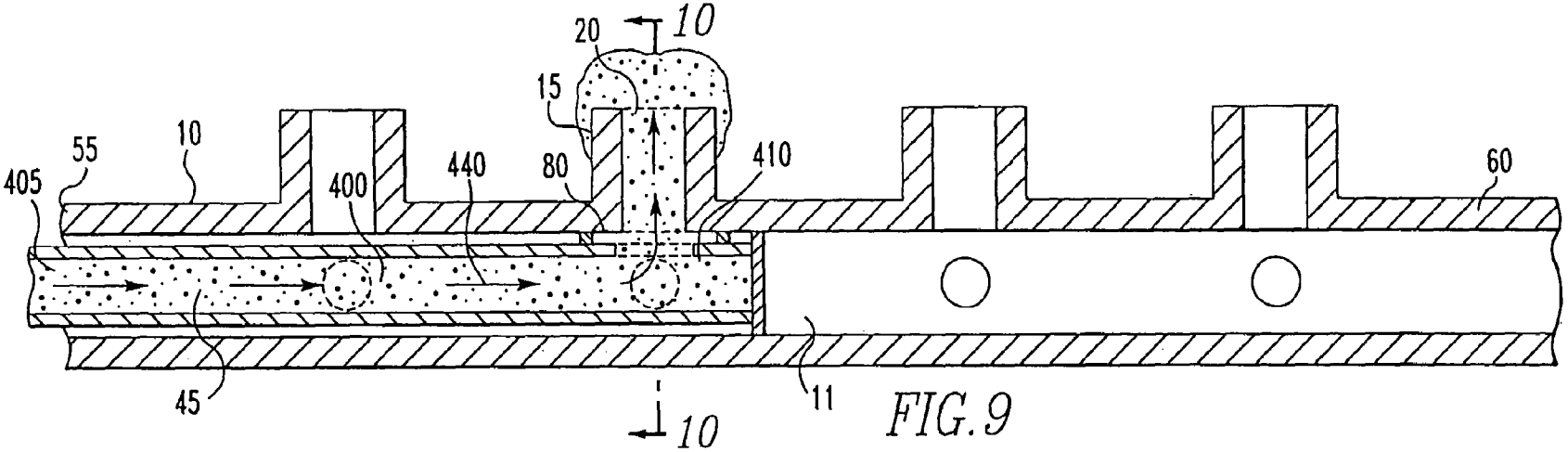
FIG. 9 is a sectional schematic illustration of a fourth embodiment of the subject invention, whereby a single media delivery tube using baffles directs the abrasive media through the opening of the branch outlet.
Figure 11:
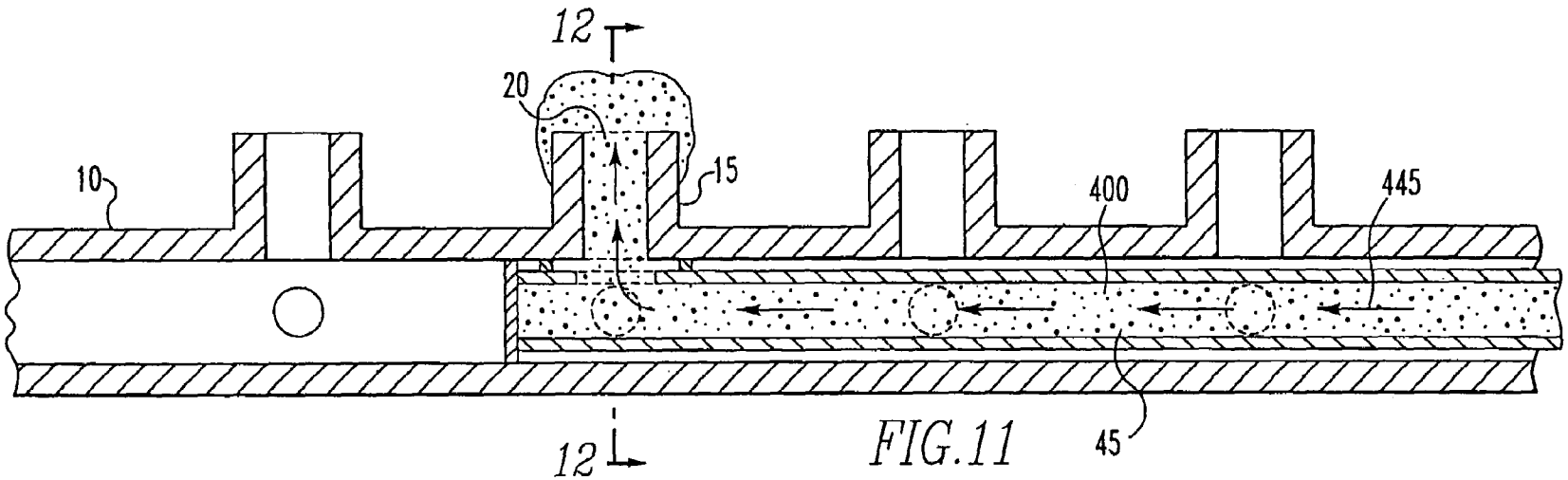
FIG. 11 is a sectional schematic illustration of an arrangement similar to that in FIG. 9, but with the media delivery tube introduced from an opposite end of the passageway.

FIG. 9 illustrates an arrangement by which guiding the media 45 is accomplished by a delivery tube 400 having an inlet 405 and an outlet 410, wherein the outlet has baffles 415, 420, 425, 430 (FIG. 13) extending from the delivery tube outlet 410. The baffles 415, 420, 425, 430 surround the intersection region 37, thereby defining a flow path for the media 45 from the delivery tube inlet 405 to the delivery tube outlet 410 and through the opening 20. The arrangement illustrated in FIG. 13 provides the opportunity for selectively directing media 45 to one particular outlet 15 (FIG. 9) by moving the delivery tube 400 along the passageway 11. While described as a plurality of distinct parts, the baffles 415, 420, 425, 430 may also be combined to form a single piece that is attached to or integral with the delivery tube 400.

When there are multiple branch outlets at the same longitudinal location along a passageway, the volume of media 45 that may be supplied through the passageway 11 may be insufficient to satisfy the volume requirements necessary for proper abrasion of multiple branch outlets at the same longitudinal location. For that reason, it may be necessary to selectively direct media 45 into one or more branch outlets at a time to the exclusion of other branch outlets at the same longitudinal location. In these instances, the delivery tube 400 with the associated baffle arrangement provides this selective guidance of media 45.

Figure 10:
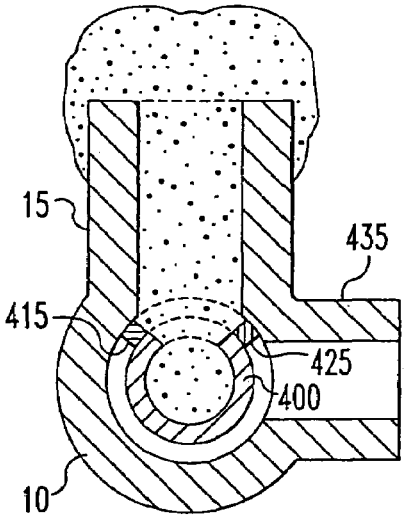
FIG. 10 illustrates a cross-sectional view along arrows X—X in FIG. 9.
Figure 12:
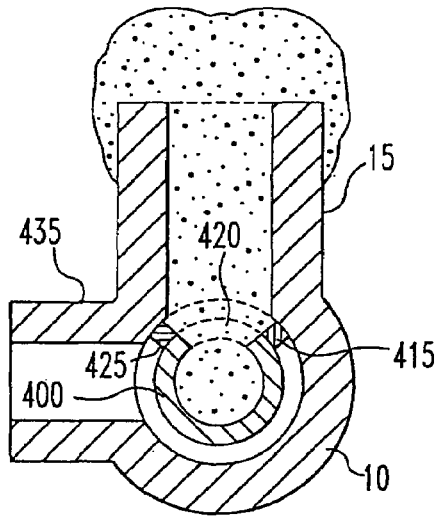
FIG. 12 is a cross-sectional view along arrows XII—XII in FIG. 11.

The baffling on the delivery tube 400 also permits the tube 400 to be rotated to selectively direct media 45 from one branch outlet 15 to a second branch outlet 435 (FIGS. 10 and 12) which may be at a same longitudinal location within the passageway 11, however, at a different angular orientation. By redirecting the outlet 410 from alignment with the branch outlet 15 to alignment with the branch outlet 435, media 45 may be supplied to the branch outlet 435 to the exclusion of branch outlet 15.

In a fashion similar to that discussed with FIGS. 4 and 5, the delivery tube 400 provides media 45 with unidirectional flow along arrow 440 and, as a result, it is necessary to remove the delivery tube 400 from the end 55 of the passageway 11 and to insert it in end 60 of the passageway 11. Particularly, after the step of guiding the media 45 to the delivery tube 400 in a first position of FIG. 9, it is necessary to reposition the delivery tube 400 within the passageway 11, wherein the delivery tube outlet 410 is proximate to the periphery 35 of the opening 20, thereby obstructing the flow of the media 45 to direct it through the opening 20 from a second direction indicated by arrow 445.

Just as previously mentioned with other embodiments, it is entirely possible to fix the location of the body 10 and to move the delivery tube 400 for positioning within the body 10 or, in the alternative, it is possible to fix the delivery tube 400 and to move the body 10 over the delivery tube 400 to properly index the tube 400 within the body 10.

What has been described is a method and apparatus for abrading the inner surface of a body having a passageway with at least one branch outlet defined by an opening extending through the wall.

The invention has been described with reference to the preferred embodiments. Obvious modifications and alterations will occur to others upon reading and understanding the preceding detailed description. It is intended that the invention be construed as including all such modifications and alterations insofar as they come within the scope of appended claims or the equivalents thereof.

I claim:

1. An assembly for abrading the inner surface of a wall of a body having a passageway in the area of a branch outlet comprised of:

a) a body having a wall with an inner surface along a passageway and at least one branch outlet defined by an opening extending through the wall;

b) a media delivery tube separate from the passageway and slidably positioned within the passageway, wherein the tube has a first inlet outside of the body and a second inlet outside of the body with an outlet therebetween and wherein, the outlet is proximate to the periphery of the opening; and c) wherein the delivery tube is adapted to receive a flowable abrasive media through the first inlet and through the second inlet of the tube for discharge from the outlet through the opening.

* * * * *